US005861789A

United States Patent [19]

Bundy et al.

[11] Patent Number: 5,861,789

[45] Date of Patent: Jan. 19, 1999

[54] DEVICE FOR MAGNETIZING TOOL BIT

[75] Inventors: Paul Bundy, Gresham, Oreg.; Wayne Eby, Danvill, Calif.; Doug Hall, Oregon City, Oreg.

[73] Assignee: Automotive Industrial Marketing Corp., Portland, Oreg.

[21] Appl. No.: 955,935

[22] Filed: Oct. 22, 1997

[51] Int. Cl.[6] ..... H01F 7/20

[52] U.S. Cl. ..... 335/285; 335/284; 81/451

[58] Field of Search ..... 335/284, 285; 81/451; 210/222, 223; 123/538

[56] References Cited

U.S. PATENT DOCUMENTS

| | | | |
|---|---|---|---|
| 3,662,303 | 5/1972 | Arllof | 335/284 |
| 3,731,722 | 5/1973 | Carr | 145/50 DA |
| 4,167,718 | 9/1979 | Harada et al. | 335/284 |
| 4,168,481 | 9/1979 | Harada et al. | 335/284 |
| 4,237,518 | 12/1980 | Krulwich | 361/267 |
| 4,552,042 | 11/1985 | Corona et al. | 81/490 |
| 4,726,588 | 2/1988 | Capril | 273/153 R |
| 5,319,335 | 6/1994 | Huang et al. | 335/284 |
| 5,502,425 | 3/1996 | Tsai | 335/304 |
| 5,577,426 | 11/1996 | Eggert et al. | 89/439 |
| 5,724,873 | 3/1998 | Hillinger | 81/451 |

*Primary Examiner*—Lincoln Donovan
*Assistant Examiner*—Tuyen T. Nguyen
*Attorney, Agent, or Firm*—William A. Birdwell & Associates

[57] ABSTRACT

A method and device for magnetizing a tool bit. A housing is adapted for removably fitting around a magnetically attractive tool bit, and a plurality of magnets are disposed in the housing and adapted for making contact with the surface of the bit, to strengthen the magnetic coupling of the magnets to the bit. The device preferably remains on the bit while employing the bit, and is especially adapted for high speed use.

6 Claims, 2 Drawing Sheets

DEVICE FOR MAGNETIZING TOOL BIT

BACKGROUND OF THE INVENTION

The present invention relates to a method and apparatus for magnetizing a tool bit, particularly by providing a magnetizing device attachable to the bit for maintaining a magnetized state of the tool bit while the device is attached, to hold magnetically attracted fasteners on the bit.

When installing a fastener such as a screw or bolt in a work-piece, it is usually necessary to hold the fastener against the force of gravity while starting the fastener, before the fastener is seated sufficiently in the work-piece to support itself For example, when using a manual screwdriver, it is a familiar and sometimes aggravating requirement to hold a screw with the fingers of one hand while starting the screw with a screwdriver held by the other hand, to prevent dropping the screw and to hold the screw in a position for the screwdriver to obtain adequate purchase. When using an electric or pneumatic power driven tool, it is likewise generally required to provide some independent means to temporarily hold the fastener in mating disposition with the tool.

One solution to this problem is to provide permanently magnetized ferrous metal bits for use with ferrous metal fasteners, so that the fasteners are magnetically attracted to the bit. This solution, however, has the disadvantage that the magnetization strength that can be imparted to a ferrous metal bit is small by comparison with the magnetization strength of better magnets, such as neodymium magnets. In addition, such high strength magnetic materials are not well suited in hardness, strength or toughness for use as bits themselves.

Accordingly, there is a need for a method and apparatus for magnetizing a tool bit that provides for improved magnetization strength in a tool bit.

SUMMARY OF THE INVENTION

The device and method for magnetizing a tool bit of the present invention solves the aforementioned problems and meets the aforementioned needs by providing a housing adapted for removably fitting around a magnetically attracted (or magnetically permeable) tool bit, and a plurality of magnets disposed in the housing and adapted for making contact with the surface of the tool bit. The housing includes an aperture therethrough to receive the bit, and an external periphery. Each of the magnets has a face having a first pole and an opposite face having a second pole. The magnets are disposed in the housing so that all of the faces having the first pole extend into the aperture, so as to make contact with the tool bit, while the faces having the second pole extend away from the aperture, toward the external periphery. Preferably, the magnets are slidingly received in the housing in corresponding pockets in the housing so as to permit the magnets to move radially inwardly toward the center of the aperture but which otherwise contain the magnets in the housing.

Preferably three neodymium magnets are employed, the three magnets being spaced around the housing so as to be substantially equidistant, angularly. In making contact with the bit, the magnets deliver a maximum of their magnetic field strength thereto, the magnetic field lines circulating from the first pole, through the bit, through the air, and back into the second pole, minimizing travel of the field lines through the air.

The device is fitted to the bit and magnetizes the bit. If the device is removed, the bit remains magnetized; however, the magnetic field is immediately less strong and, moreover, it decays quickly with time. Therefore, it is preferable to leave the device on the bit until it is time to discard the bit. To that end, the device is particularly adapted for the high speeds of revolution of electric and pneumatic power tools. Just as if the bit were permanently magnetized, the magnetization of the bit remains at full strength during this time. However, relative to permanently magnetized tool bits of the prior art, the present invention provides for a significantly stronger magnetization strength in a tool bit that has normal mechanical properties, such as strength, hardness and toughness.

Therefore, it is a principal object of the present invention to provide a novel and improved device and method for magnetizing a tool bit.

It is another object of the present invention to provide such a device and method that provides for an improved magnetization strength in magnetizing the tool bit.

It is still another object of the present invention to provide such a device and method that provides for such improved magnetization strength in a tool bit having normal mechanical properties.

It is yet another object of the present invention to provide such a device and method that provides retains the aforementioned improved magnetization during use of the tool bit.

It is further object of the present invention to provide such a device and method that is adapted for use in a high speed electric or pneumatic tool.

It is still a further object of the present invention to provide such a device and method that provides for easy removal of the device from a worn tool bit and replacement onto a fresh tool bit.

It is yet a further object of the present invention to provide such a device and method that provides for the aforedescribed objects, features and advantages at a reduced cost.

The foregoing and other objects, features and advantages of the present invention will be more readily understood upon consideration of the following detailed description of the invention, taken in conjunction with the following drawings.

BRIER DESCRIPTION OF THE DRAWINGS

DETAILED DESCRIPTION OF A PREFERRED EMBODIMENT

Figure 1:
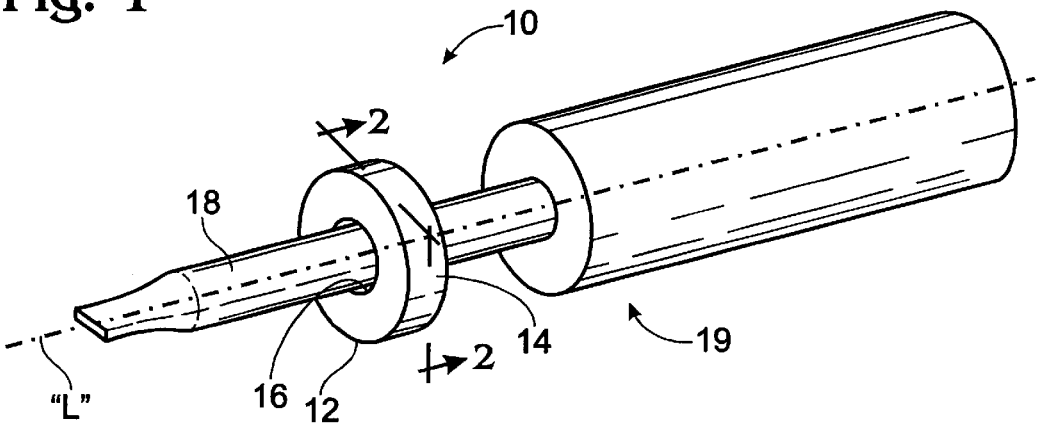
FIG. 1 is a pictorial view of a tool bit and a device for magnetizing a tool bit according to the present invention, attached to the tool bit according to a method of the present invention.
Figure 2:
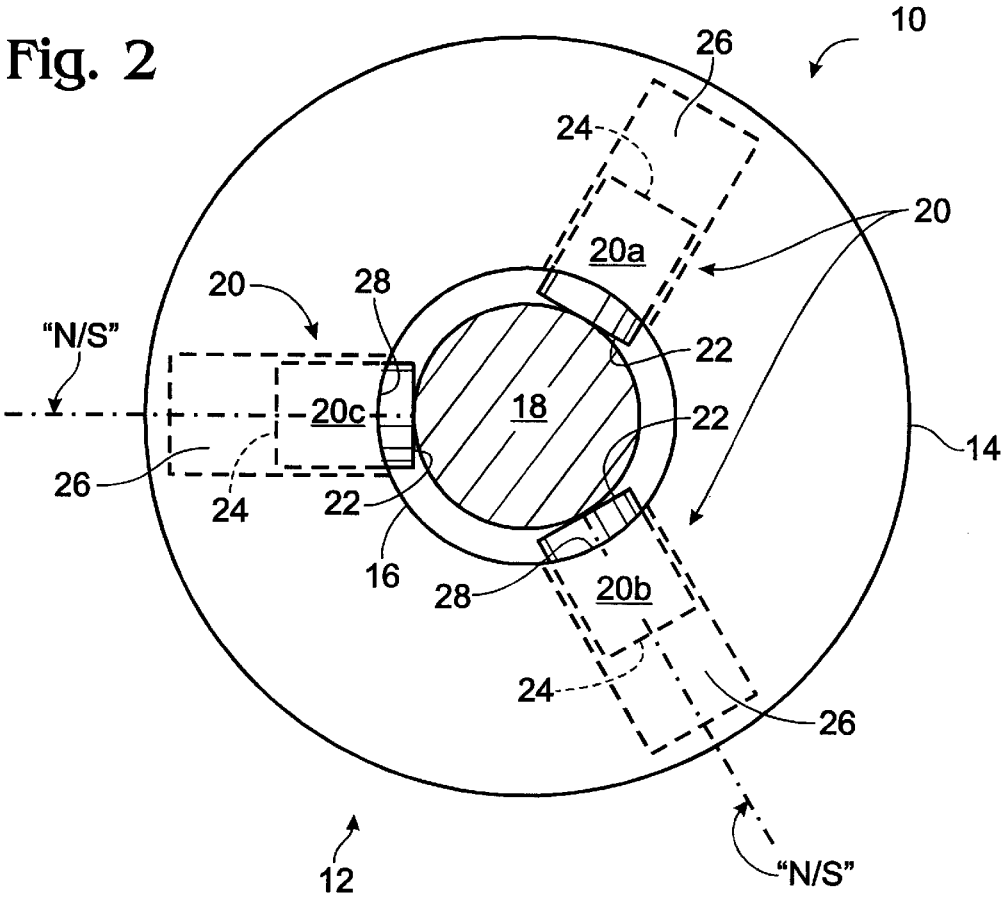
FIG. 2 is a plan view of the device of FIG. 1.

Referring to FIGS. 1 and 2, a preferred embodiment of a device 10 for magnetizing a magnetically attractive tool bit 18 according to the present invention includes a housing 12 having an external periphery 14 and a central aperture 16 through the housing, for receiving the bit 18 of a tool 19. For reference, the aperture 16 has a central axis "L." The tool 19 may be any tool adapted for applying a magnetically attractive fastener through a work-piece, including but not limited to electric, pneumatic or hand-driven tools such as screwdrivers. Herein, a magnetically attractive material is a material that can be attracted by a magnetic field, such as most ferrous metals.

Typically, the aperture 16 is circular, adapted for fitting to a bit 18 of circular cross-section, and the housing has a circular external periphery 14. It is generally preferable to employ radial symmetry in the shape of the housing 12 for the reason described further below. Therefore, even if the bit is not circular in cross-section, a circular external periphery 14 is desirable. Nevertheless, the housing may be formed into other shapes, including ornamental and novelty shapes, without departing from the principles of the invention.

A plurality of magnets 20 are provided in the housing, both for magnetizing the bit and for holding the device 10 firmly thereto. The magnets are distributed around the interior of the housing 12 as will be described further below. Preferably, three, high strength magnets 20*a*, 20*b* and 20*c* formed, for example, from neodymium are employed.

Each of the magnets includes a face 22 having arbitrarily chosen north or south pole and an opposite face 24 having a south or north pole, respectively. The magnets are oriented in the housing so that each of the magnets are permitted to contact the bit 18 when inserted through the aperture 16. The other face 24 of the magnets extend toward the external periphery 14 of the housing. North-South axes "N/S" of the magnets are thereby disposed perpendicular to the axis "L".

The faces 22, having like magnetic polarity, naturally repel each other. However, when the bit 18 is inserted through the aperture 16, the faces 22 are attracted to the bit and thereby are pulled radially inwardly so as to contact the bit. The resulting lack of an air gap between the faces 22 of the magnets and the bit improves magnetic coupling therebetween for greater magnetization strength. The magnetic lines of force circulate from one pole of each of the magnets directly into and through the bit, through the air, and back into the other poles, minimizing travel of the field lines through the air.

The magnets may be fixed in the housing, and the faces 22 may be substantially congruent with the periphery of the aperture 16, or may be some other shape and extend into the aperture 16. Preferably, however, the magnets reside in associated pockets 26. The pockets provide a number of functions. First, the pockets permit the magnets, when no bit is inserted through the aperture 16 and the faces 22 repel one another, to bias themselves away from and out of the aperture 16, for easy fitting of the device 10 thereto. Second, the pockets permit the magnets to move radially inwardly, into the aperture to contact the bit 18 when the bit is present in the aperture. Third, the pockets maintain separation between the faces 22 of the magnets. Fourth, the pockets contain the magnets in an optimum angular relationship in the housing.

Referring particularly to the first and second of the aforementioned functions, the pockets are adapted to slidably receive the magnets along their North-South axes. Proximate the external periphery 14, the pockets extend far enough from the aperture 16 that the magnets may be substantially entirely contained within the interior of the housing. This position is shown by the magnet 20*b* in FIG. 3A, the position being that of all of the magnets when the bit is not present in the aperture.

Figure 3A:
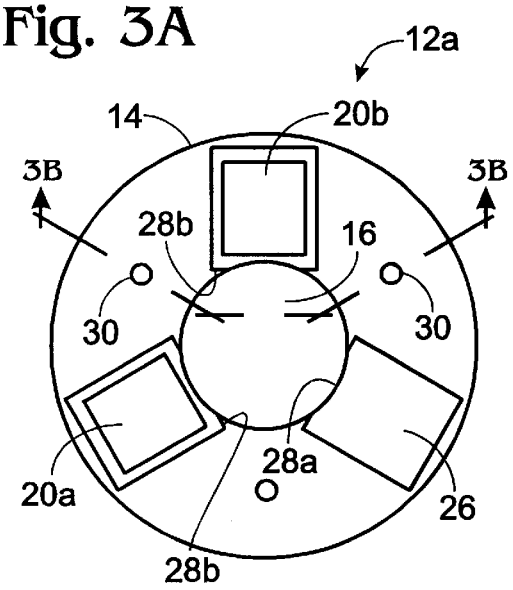
FIG. 3A is a plan view of a first portion of a device for magnetizing a tool bit along with two magnets shown in illustrative positions within pockets, according to the present invention.

The pockets have open ends 28 at the aperture 16 which allow the magnets to slide at least a portion of the faces 22 into the aperture to contact the bit. This position is shown by the magnet 20*a* in FIG. 3A, the position being that of all of the magnets when the bit is present in the aperture. The open ends 28 may be fully open and permit the entirety of the faces 22 to slide out of the pockets and into the aperture or, as is preferred, may be partially open as shown in FIG. 3A so that only a portion of the faces 22 may slide into the aperture. One advantage of this latter, preferred structure is its tidy appearance. Ledges 28*b* may also be included to constrain the magnets from moving further into the aperture 16.

Notwithstanding the preferred inclusion of the pockets 26 permitting the magnets to adjust their positions to accommodate varying sizes of bits, it is nonetheless often commercially preferable to manufacture the housing 12 for specific bit sizes. The size of the aperture is then just slightly larger than the cross-section diameter of the maximally toleranced bit. This provides for the neatest appearance of the device 10, and calls upon the aforementioned features to accommodate only manufacturing tolerances.

Referring particularly to the fourth function of the pockets mentioned above, the pockets are preferably disposed so as to distribute the magnets substantially equidistantly angularly around the interior of the housing, with respect to the axis "L". For three magnets 20, the magnets are spaced angularly apart about 120 degrees from one another around the axis "L."

Figure 4A:
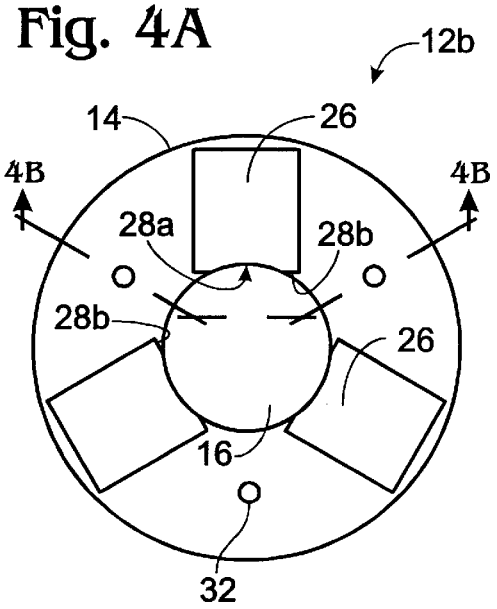
FIG. 4A is a plan view of a mating, second portion of the device of FIG. 3A.
Figure 3B:
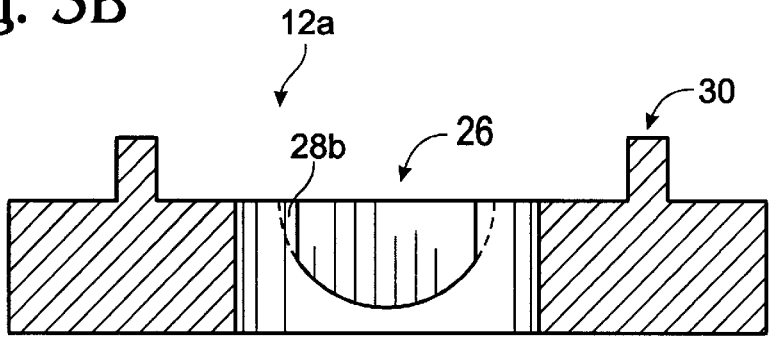
FIG. 3B is a cross-section of the half of the device of FIG. 3A, taken along a line 3B—3B thereof.
Figure 4B:
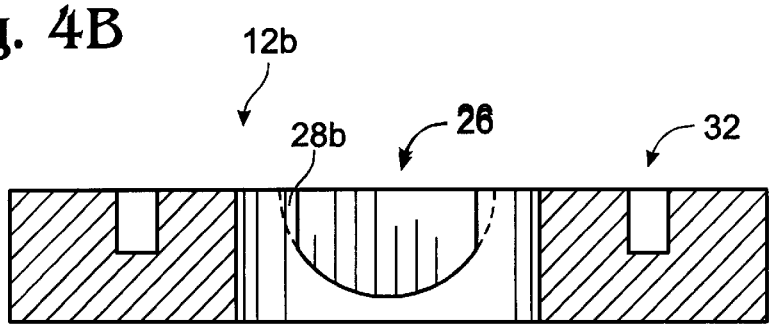
FIG. 4B is a side elevation of the half of FIG. 4A.

Referring again to FIGS. 3A and 4A, complementary half portions 12*a*, 12*b* ("halves") of the housing 12 are preferably employed in fabricating the device 10. The halves 12*a*, 12*b* are, for example, compression molded of a lightweight plastic, with the pockets 26 integrally formed to fit, for example, cylindrically shaped neodymium magnets of about a ¼" diameter and about a ¼" length having flat faces 22 and 24. The halves may be joined around the magnets 20 by seating interfering pins 30 into complementary apertures 32, or the halves may be joined by other means known in the art, such as ultrasonic welding or adhesive bonding, to form the housing 12. Other means for fabricating the housing 12 and other configurations of the pockets and magnets may be employed without departing from the principles of the invention.

Referring back to FIG. 1, the device 10 is placed over the bit 18 and, preferably, remains in place during use. The tool is then used, with the device in place, to start and complete the placement of a fastener. The device is particularly adapted for high speed use, permitting the high speeds of revolution, such as 8,000 RPM, of electric and pneumatic power tools. The neodymium magnets provide a high magnetic field strength in respect to their mass and the lightweight plastic of the housing decreases further the centrifugal forces on the device. Moreover, as aforedescribed, the magnets are preferably disposed around the housing 12 substantially equidistantly angularly and the housing preferably has a radially symmetric or other configuration, so that the device 10 has a center of mass that is located substantially at the center of the aperture 16. For a circular aperture 16 and a bit 18 of circular cross-section, the center of the aperture coincides with the center of the bit, so that the device has a good dynamic balance when it is magnetically coupled to the bit.

It is to be recognized that, while a specific device and method for magnetizing a tool bit has been shown as preferred, other configurations could be utilized, in addition to configurations already mentioned, without departing from the principles of the invention. For example, whereas the term "bit" has been employed to describe the portion of a tool that couples to a fastener for driving the fastener, the metal shank or other parts of a tool may be magnetized with the device 10 without departing from the principles of the invention. Further, the housing may be formed by means other than that described, from other materials without departing from the principles of the invention. Then, adaptations to the aforedescribed structure in consonance with the principles of the invention will be apparent to those having ordinary skill in the fabrication arts.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

We claim:

1. A magnetizing device for use with a magnetically attractive tool bit having a predetermined size, comprising:

a housing; and a plurality of magnets disposed at least partially within said housing, said magnets each having a north pole and a south pole, a same one of said north pole and said south pole of each of said magnets being disposed proximate one another, wherein said magnets are spaced apart by the magnetic fields thereof and form an opening that is larger than the predetermined size of the bit, said housing and said magnets being adapted in cooperation to permit at least one of said magnets to move into contact with the bit when the bit is placed through said opening.

2. The magnetizing device of claim 1, wherein said housing has an aperture that is larger than the predetermined size of the bit, wherein said opening is substantially concentric with said aperture, and wherein said magnets are movably disposed in corresponding pockets in said housing, said pockets having corresponding ends opening into said aperture, said pockets being adapted to permit said magnets to move through said ends and into said aperture to contact the bit.

3. The magnetizing device of claim 1, wherein, when said magnets are positioned the same radial distance from the center of the aperture, the center of mass of said device is located substantially at the center of said aperture.

4. The magnetizing device of claim 1, wherein said magnets are disposed substantially equidistantly angularly around said housing.

5. The magnetizing device of claim 4, wherein the magnetizing device has three said magnets disposed angularly around said housing about 120 degrees apart from each other.

6. The magnetizing device of claim 1, wherein said magnets include neodymium.

* * * * *